US006285328B1

(12) United States Patent
Masaki et al.

(10) Patent No.: US 6,285,328 B1
(45) Date of Patent: Sep. 4, 2001

(54) ANTENNA ARRANGEMENT OF AN INFORMATION PROCESSOR

(75) Inventors: Toshiyuki Masaki; Koichi Kobayashi, both of Saitama-ken; Yoshinori Horiguchi, Tokyo; Toshiki Miyasaka, Saitama-ken; Hiroki Iwahara, Tokyo; Syuichi Sekine, Kanagawa-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/456,986

(22) Filed: Dec. 7, 1999

(30) Foreign Application Priority Data

Dec. 8, 1998 (JP) ..... 10-348618

(51) Int. Cl.[7] ..... H01Q 1/24
(52) U.S. Cl. ..... 343/702; 455/90
(58) Field of Search ..... 343/702, 901; 455/90, 575

(56) References Cited

U.S. PATENT DOCUMENTS

| | | | | |
|---|---|---|---|---|
| 5,373,300 | * | 12/1994 | Jenness et al. | 343/702 |
| 5,677,698 | | 10/1997 | Snowdon | 343/702 |
| 5,819,185 | * | 10/1998 | Umezawa et al. | 455/575 |
| 6,031,497 | * | 2/2000 | Nam | 343/702 |

FOREIGN PATENT DOCUMENTS 10-322355 12/1998 (JP) .

* cited by examiner

*Primary Examiner*—Don Wong
*Assistant Examiner*—James Clinger
(74) *Attorney, Agent, or Firm*—Finnegan, Henderson, Farabow, Garrett & Dunner, L.L.P.

(57) ABSTRACT

An information processor includes a display case having a display panel therein. A antenna is disposed in an upper end of the display case opposite a hinge mechanism connecting the display case to a main body. The display case is movable between an open and a closed position. The antenna has radiation characteristics that provide reception and transmission capability when the display case is either in the open or closed position.

27 Claims, 12 Drawing Sheets

ANTENNA ARRANGEMENT OF AN INFORMATION PROCESSOR

BACKGROUND OF THE INVENTION

1. Field of the Invention

The present invention relates to an information processor, such as a notebook-type personal computer and a palm-top personal computer, equipped with radio data communication via an antenna.

2. Discussion of the Background

Personal computers use radio data communication. According to the conventional antenna technology, a plurality of antennas suitable for bands of different frequencies are commonly used as one antenna unit. Specifically, the antenna technology includes a frequency shared antenna unit that allows communication in the frequencies of PHS (personal handy phone) and cellular phone in a system requiring antennas whose beam is restricted like the high speed radio LAN and arrayed in the peripheral direction.

An antenna using this technology includes a cylindrical antenna and a rod antenna, whose shapes are different from each other, which are combined and used commonly as one antenna. The antennas of different frequency bands may be combined as one antenna by disposing the cylindrical antenna (e.g., used at a frequency of about 20 GHz) on the external surface thereof and by mounting the rod antenna (e.g., a whip antenna, used at a frequency of about 2 GHz band) on the internal surface of the cylindrical antenna. Such an antenna takes advantage of the different shapes of the flat antenna and the whip antenna by mounting the cylindrical antenna on the cylindrical surface and by mounting the rod-like whip antenna in a space in the inside of the cylindrical antenna.

However, the structure of such an antenna does not consider the influence on the radiation patterns (directional characteristics) of the antenna when the antenna is used in a personal computer having a normal display case or the influence of unnecessary radiation from the main body of the personal computer. Hence, such an antenna may fall short of expectations of performing stable transmitting and receiving operations. Further, because the antenna requires a wide space within the case, it has been an obstacle in miniaturizing and packaging the apparatus in high density. In particular, because no consideration has been taken on radiation patterns (directional characteristics) of the antenna under a weak field strength and further on the transmitting/receiving environment around the antenna which is affected by an operator (human body may be considered to be a conductor approximately) during its use, it may also fall short of expectations of performing the stable transmitting and receiving operations under the weak field strength. Accordingly, such an antenna cannot be applied to a portable and small personal computer, which includes many circuits that generate high frequency noise (e.g. various types of drivers including a processor) and are packaged within the main body of the computer. Nor is such antenna technology usable under a weak field strength.

One computer has an antenna which is arranged along the periphery of the display frame for receiving radio communication with a wireless LAN. The antenna also is near the handle of the display frame which is disposed at an end of the display frame that is opposite a hinge mechanism coupling the display frame to a computer body that includes a keyboard. Such a system is described in Japanese laid-open Patent Number 10-322355. This system does not account for interference from the operating frequency of a processor in the computer.

Accordingly, in view of the above-mentioned problems, it is an object of the present invention to provide an improved information processor with a radio data communication unit.

It is another object of the present invention to provide an information having increased antenna performance, reduced influence of noise and which provides more stable and reliable transmitting/receiving operations without being significantly influenced by the location where it is used, the condition when it is used, or its surrounding environment when the radio communication function is packaged as standard for such information processor.

It is another object of the present invention to provide an information processor which allows an operator to have highly reliable radio data communication by improving antenna radiation pattern characteristics for radio communication and by allowing the operator to have stable transmitting/receiving operations even under unnecessary radiation from the main body of an apparatus when the radio communication function is packaged in a computer apparatus such as a note-type personal computer and a palm-top personal computer in which a display case is turnably movable provided with respect to the main body via a hinge mechanism.

It is a further object of the present invention to provide an information processor which does not require a wide space for mounting an antenna within a display case and which allows stable transmitting/receiving operations under weak field strength in a portable computer or the like in which many circuits which generate high frequency noise.

SUMMARY OF THE INVENTION

The present inventive information processor includes a display unit that has an indented region. An antenna is mounted in the indented region without detracting the antenna performance, to minimize the influence of noise and to maintain stable and reliable transmitting/receiving operations without influence of the location where it is used, the condition when it is used, its surrounding environment and the like by providing the antenna on the display unit and by specifying the mounting position and configuration of the antenna in packaging a radio communication function in standard.

In the present invention, the information processor may provide stable transmitting/receiving operations without detracting the antenna performance by a flat antenna disposed at a specific position of the display unit (e.g., approximately at the center of a free end of the display unit) where the antenna radiation pattern is improved because the antenna is separated from sources of noise (such as a CPU) and can transmit/receive at that position even when the display case is opened or closed.

In the present invention, the information processor includes a display unit. An antenna is disposed at a specific position on the display unit, so as to not project from the plane of the display unit, for radio data communications with an external apparatus. In the present invention, the information processor includes a display unit which is turnably supported by a main unit of an apparatus via a hinge mechanism disposed at the lower end thereof. A flat antenna is disposed at a predetermined region of the display unit where it is exposed to the outside for radio communicating when the display unit is closed.

The present invention may also provide the flat antenna being disposed at a predetermined region of the display unit where it is exposed to the outside when the display unit is opened.

In the present invention, the predetermined region may be on the upper surface portion of the display unit.

In the present invention, the predetermined region may be approximately at the center of the upper surface portion of the display unit.

In another aspect of the present invention, the information processor comprises a flat antenna disposed on an upper surface portion of the display unit. A display driver circuit for the display unit is disposed adjacent to one side of the display unit. A coaxial cable coupled between the flat antenna and the main body is routed via another side of the display unit.

The present invention may include the information processor, a flat antenna provided on the upper surface portion of the display unit; and a shielding case for electrically shielding the surrounding of the flat antenna except in the radiation direction of the flat antenna.

In the present invention, the information processor may further comprise an opening lock button disposed approximately at the center of the free end of the display unit, and a flat antenna inserted in the opening lock button.

In the present invention, the flat antenna may be disposed so that its directivity pattern extends in front of and in the back of the display unit.

In the present invention, the flat antenna may be disposed so that its directivity pattern extends above when seen from the front of the display unit.

In the present invention, the flat antenna may be disposed so that its directivity pattern extends above from the front and back planes when seen from the side of the display unit.

In the present invention, a wide space for mounting the antenna is not required within the display unit, and stable transmitting/receiving operations may be performed even under the weak field strength in the portable computer in which a large number of circuits which generate high frequency noise are packaged within the main body of the apparatus.

The specific nature of the present invention, as well as other objects, uses and advantages thereof, will clearly appear from the following description and from the accompanying drawings in which like reference numerals refer to like parts.

DESCRIPTION OF THE PREFERRED EMBODIMENTS

Preferred embodiments of the present invention are explained below with reference to the drawings. Here, the embodiments of the present invention are explained by exemplifying a technology for mounting a radio communication antenna in a notebook-type personal computer.

Figure 1A:
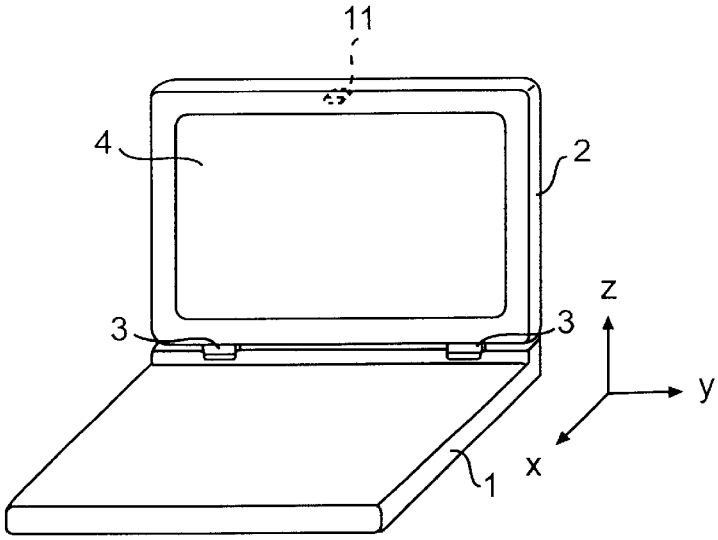
FIGS. 1*a*, 1*b*, and 1*c* are a perspective view, a front plan view, and a side plane view, respectively, illustrating a notebook personal computer including an antenna and in an open state in accordance with a first embodiment of the present invention.
Figure 1B:
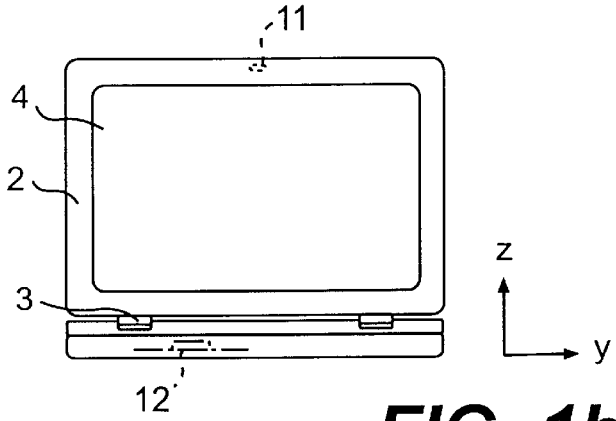
Figure 1C:
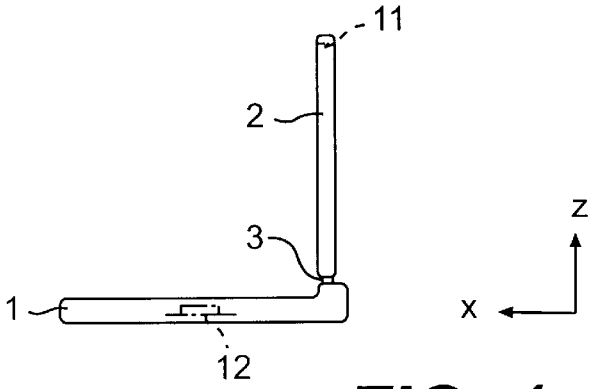

FIGS. 1*a*, 1*b*, and 1*c* are a perspective view, a front plan view, and a side plane view, respectively, illustrating a notebook personal computer including an antenna and in an open state in accordance with a first embodiment of the present invention. The notebook personal computer comprises a main unit 1, a display unit 2, a plurality of hinge mechanisms 3, a liquid crystal display panel 4, a flat antenna 11, and a central processing unit (CPU) 12.

The plurality of hinge mechanisms 3 are mounted between the main unit 1 and the display unit 2. The display unit 2 is tiltable relative to the main unit 1 via the plurality of hinge mechanisms 3 so that the display unit 2 is movable between a closed position in which the display unit 2 is disposed adjacent the main unit 1 and an open position in which an end of the display unit 2 opposite the plurality of hinge mechanisms 3 is spaced apart from the main unit 1. Such opening and closing of the display unit 2 is similar to opening and closing of the front cover of a book. The flat antenna 11 of a chip mount type as shown below in FIG. 6 for example is disposed approximately at the center part of the distal end (upper surface of the display unit 2) of the liquid crystal display unit 2. The CPU 12 is mounted on a main board (not shown) within the main unit 1 and may be a source of high frequency noise.

The flat antenna 11 is disposed at the center of the distal part of the display unit 2 so that the direction of the antenna directivity is 90 degrees with respect to the liquid crystal display panel 4. That is, the flat antenna 11 is disposed so that the flat antenna 11 is perpendicular to the panel surface of the liquid crystal display panel 4.

The antenna radiation characteristic is insignificantly biased by configuring the antenna as described above on the display unit 2 because the position of the flat antenna 11 is almost symmetrical with respect to the display unit 2.

Figure 2A:
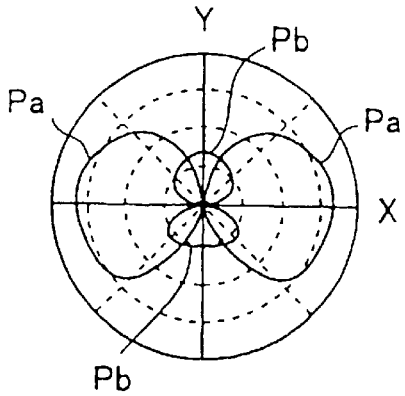
FIGS. 2*a* through 2*c* show the radiation characteristics of the flat antenna when the notebook personal computer of FIG. 1 is in an open position in accordance with the first embodiment of the present invention.
Figure 2B:
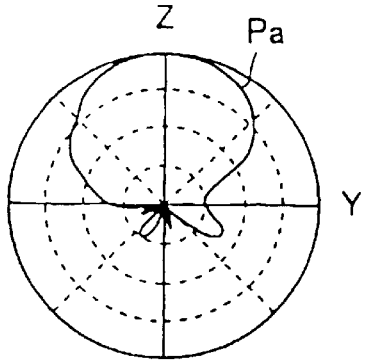
Figure 2C:
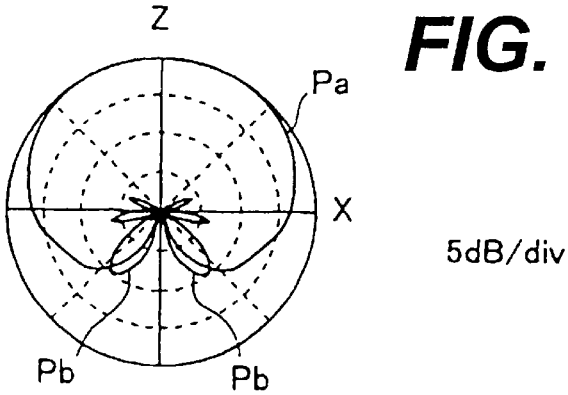
Figure 2D:
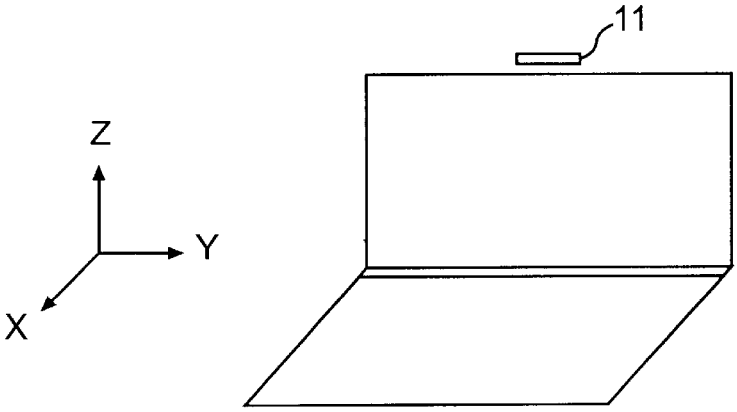
FIG. 2*d* shows the orientation of the flat antenna of the notebook personal computer of FIG. 1 for the radiation characteristics of FIGS. 2*a* through 2*c* in accordance with the first embodiment of the present invention.

FIGS. 2*a* through 2*c* show the radiation characteristics of the flat antenna 11 when the notebook personal computer of FIG. 1 is in the open position in accordance with the first embodiment of the present invention. FIG. 2*d* shows the orientation of the flat antenna 11 relative to the notebook personal computer in accordance with the first embodiment of the present invention shown in FIGS. 2*a* through 2*c*. Specifically, FIG. 2*a* shows the radiation characteristic in the Y-X plane seen from the Z direction (above the display unit 2) shown in FIG. 2*d*. FIG. 2*b* shows the radiation characteristic in the Z-Y plane seen from the −X direction (behind the display unit 2) shown in FIG. 2*d*. FIG. 2*c* shows the radiation characteristic in the Z-X plane seen from the −Y direction (side of the display unit 2) shown in FIG. 2*d*. In each radiation characteristic pattern, a reference indicator Pa indicates the radiation characteristic caused by a horizontal polarized wave and a reference indicator Pb indicates the radiation characteristic caused by a vertical polarized wave.

As shown in FIGS. 2*a* through 2*d*, the flat antenna 11 is disposed so that its directivity pattern extends in front of and behind the liquid crystal display panel 4 (see FIG. 2*a*). The flat antenna 11 is also disposed so that its directivity pattern extends above the liquid crystal display panel 4 when seen from the front side thereof (see FIG. 2*b*). Further, the flat antenna 11 is disposed so that its directivity pattern extends above the front and the back of the liquid crystal display panel 4 when seen from its side (see FIG. 2*c*).

As shown in FIGS. 2*a* through 2*d*, favorable characteristics with respect to the horizontal polarized wave may be obtained on each of the Y-X plane (FIG. 2*a*), the Z-Y plane (FIG. 2*b*) and the Z-X plane (FIG. 2*c*) by configuring the antenna as described above in the first embodiment of the present invention.

Further, it is less likely that the hands and fingers of the operator touch or shield the flat antenna 11 when the operator manipulates the notebook-type personal computer by mounting the flat antenna 11 at the position specified as described above. Additionally, while it is desirable to put the flat antenna 11 at as high of a position as possible in view of partitions and ambient environments when the personal computer is placed on a desk top, the position described above is the highest when the display unit 2 is opened, thus obtaining a favorable receiving condition.

Figure 3:
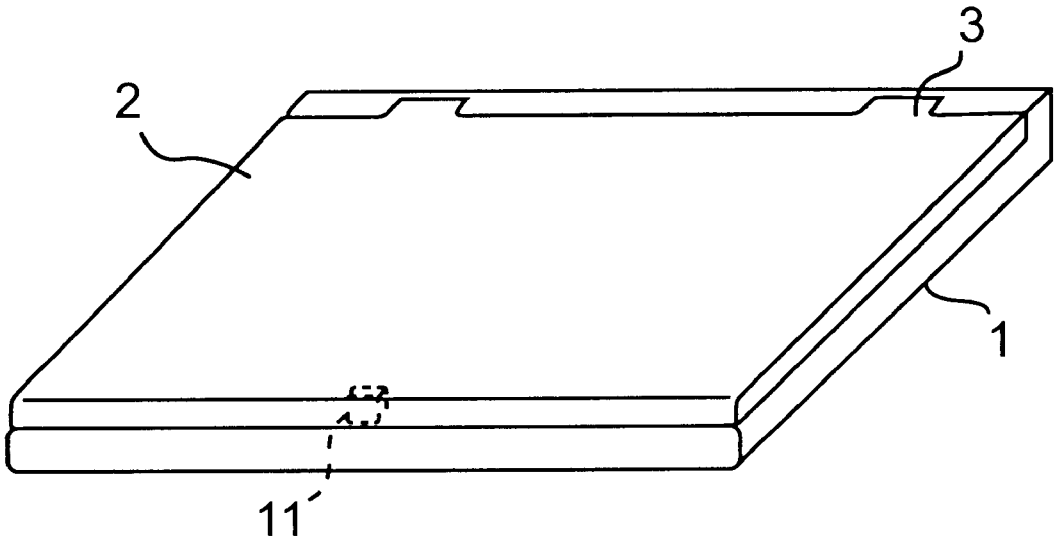
FIG. 3 is a perspective view illustrating the notebook personal computer of FIG. 1 in a closed position and the orientation of the flat antenna mounted in the display case in accordance with the first embodiment of the present invention.

FIG. 3 is a perspective view illustrating the notebook personal computer in a closed position and the orientation of the flat antenna 11 mounted in the display unit 2 in accordance with the first embodiment of the present invention.

It is desirable to locate the flat antenna 11 in an environment in which the flat antenna 11 can readily receive also when the liquid crystal display unit 2 is closed in order to have data communication by actuating the notebook personal computer by a communication function from 10 a state in which its power supply is OFF.

The flat antenna 11 is not hidden and has a directivity almost directional outwardly even when the display unit 2 is closed by mounting the flat antenna 11 at the position described above, so that a favorable receiving environment may be obtained also when the personal computer is stored in a bag for example.

Figure 4A:
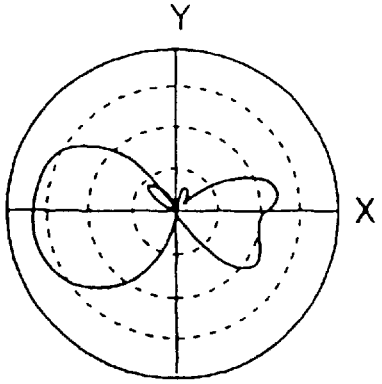
FIGS. 4*a* through 4*c* show the radiation characteristics of the flat antenna when the notebook personal computer of FIG. 1 is in the closed position in accordance with the first embodiment of the present invention.
Figure 4B:
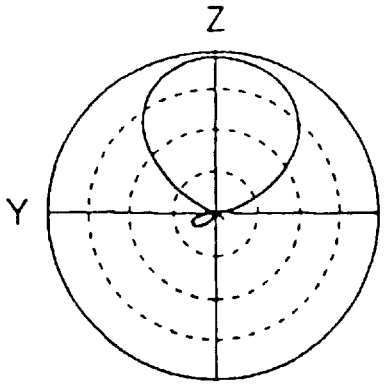
Figure 4C:
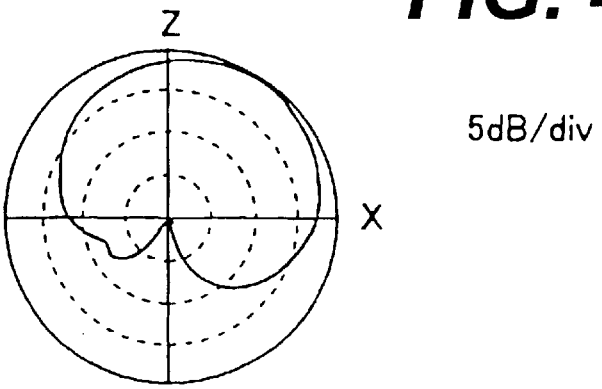
Figure 4D:
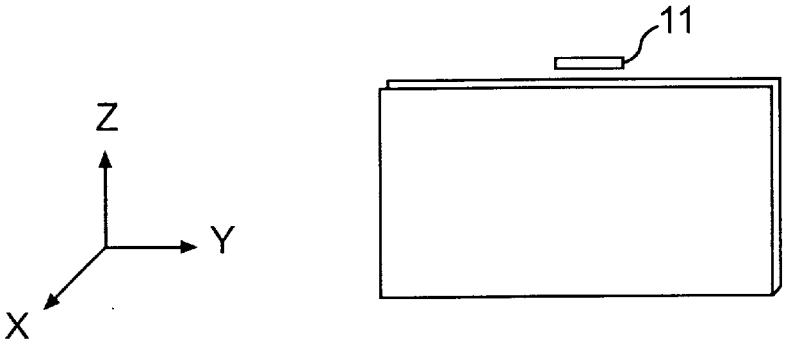
FIG. 4*d* shows the orientation of the flat antenna when the notebook personal computer of FIG. 1 for the radiation characteristics of FIGS. 4*a* through 4*c* in accordance with the first embodiment of the present invention.

FIGS. 4*a* through 4*c* show the radiation characteristics of the flat antenna 11 when the notebook personal computer is in the closed position in accordance with the first embodiment of the present invention. FIG. 4*d* shows the orientation of the flat antenna 11 when the notebook personal computer is in the closed position in accordance with the first embodiment of the present invention shown in FIGS. 4*a* through 4*c*. Specifically, FIG. 4*a* shows the radiation characteristic in the Y-X plane caused by a horizontal polarized wave seen from the Z direction (above the display unit 2) shown in FIG. 4*d*. FIG. 4*b* shows the radiation characteristic in the Z-Y plane seen from the −X direction (behind the display unit 2) shown in FIG. 4*d*. FIG. 4*c* shows the radiation characteristic in the Z-X plane seen from the −Y direction (side of the display unit 2) shown in FIG. 4*d*.

As shown in FIGS. 4*a* through 4*d*, favorable characteristics having less bias may be obtained in each of the Y-X plane (FIG. 4*a*), the Z-Y plane (FIG. 4*b*) and the Z-X plane (FIG. 4*c*).

Figure 5A:
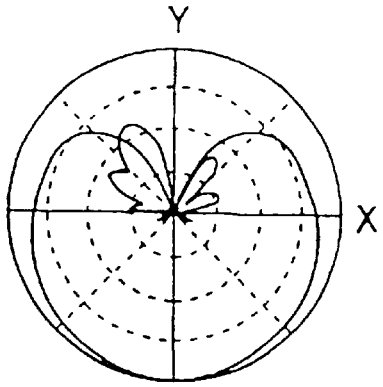
FIGS. 5*a* through 5*c* show the radiation characteristics of the flat antenna of FIG. 1 mounted in another position in accordance with the variation of the first embodiment of the present invention.
Figure 5B:
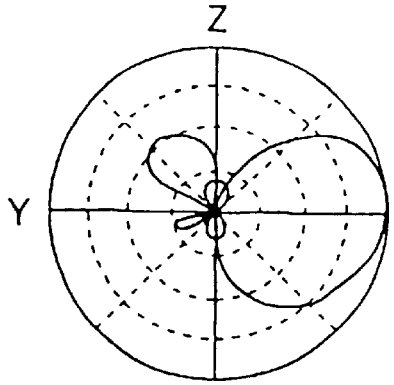
Figure 5C:
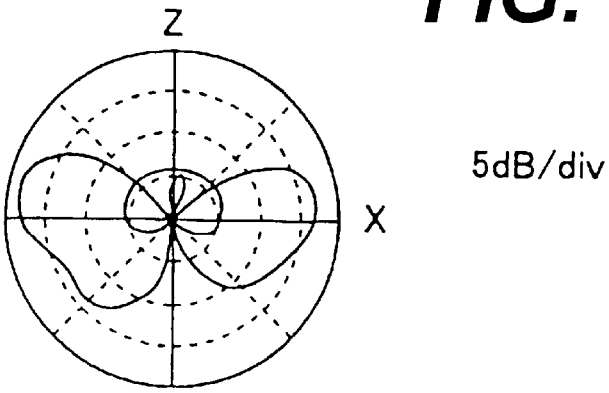
Figure 5D:
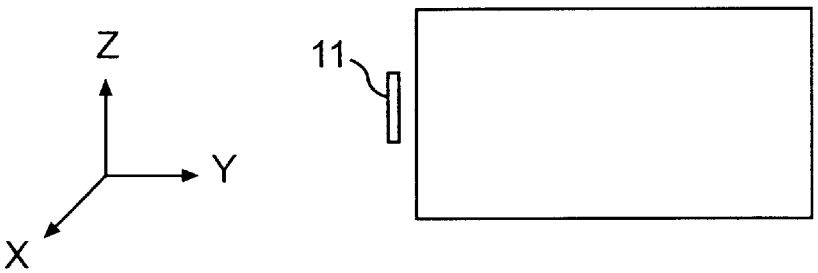
FIG. 5*d* shows the orientation of the flat antenna of FIG. 1 mounted in another position in accordance with the variation of the first embodiment of the present.

FIGS. 5*a* through 5*c* show the radiation characteristics of the flat antenna 11 mounted in another position in accordance with the variation of the first embodiment of the present invention. FIG. 5*d* shows the orientation of the flat antenna 11 mounted in another position in accordance with the variation of the first embodiment of the present invention. In this variation, the flat antenna 11 is disposed on one side portion of the display unit 2.

Specifically, FIG. 5*a* shows the radiation characteristic in the Y-X plane caused by a horizontal polarized wave seen from the Z direction (above the display unit 2) shown in FIG. 5*d*. FIG. 5*b* shows the radiation characteristic in the Z-Y plane seen from the −X direction (behind the display unit 2) shown in FIG. 5*d*. FIG. 5*c* shows the radiation characteristic in the Z-X plane seen from the −Y direction (side of the display unit 2) shown in FIG. 5*d*.

As shown in FIGS. 5*a* through 5*d*, the directivity in the Y direction is much worse in the radiation characteristic caused by the horizontal polarized wave in the Y-X plane seen from the Z direction (from above the case) in FIG. 5*a* and the directivity in the Y direction is also much worse in the radiation characteristic of the Z-Y plane seen from the X direction (from the front of the panel) in FIG. 5*b*, as compared to FIGS. 2*a*, 2*b*, and 2*c*.

Figure 6:
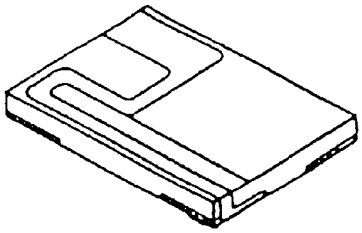
FIG. 6 is a perspective view showing a wire coupled antenna that is a chip mount type as an exemplary antenna of the flat antenna of FIG. 1.
Figure 7:
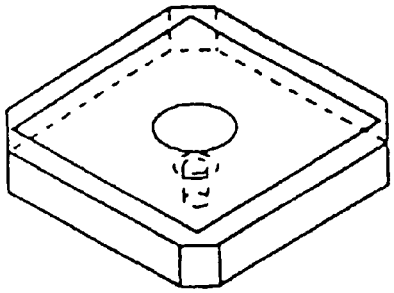
FIG. 7 is a perspective view showing a patch antenna as an exemplary antenna of the flat antenna of FIG. 1.
Figure 8:
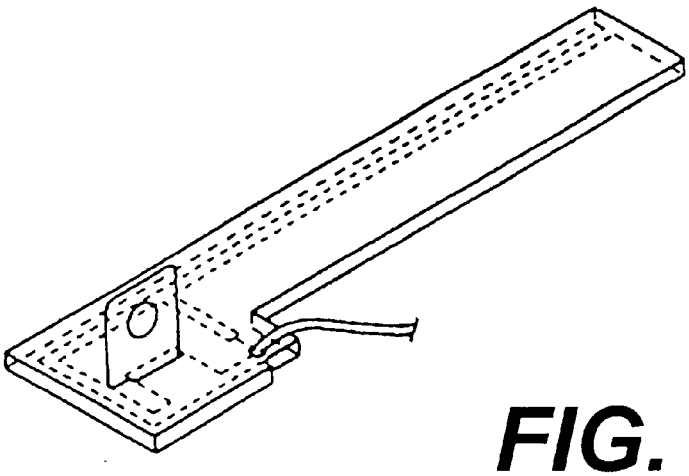
FIG. 8 is a perspective view showing an inverted-F antenna as an exemplary antenna of the flat antenna of FIG. 1.

FIGS. 6 through 8 show exemplary structures of the flat antenna 11 that are applicable to the embodiment described above. FIG. 6 is a perspective view showing a wire coupled antenna as an exemplary flat antenna 11. FIG. 7 is a perspective view showing a patch antenna as an exemplary flat antenna 11. The antennas shown in FIGS. 6 and 7 may be ceramic antennas. FIG. 8 is a perspective view showing an inverted-F antenna. It is noted that in addition to those described above, small flat antennas having other shapes and structures may be applied to the embodiments described herein.

Next, other embodiments of the present invention are described with reference to FIGS. 9 through 14. It is noted that the same reference numerals with those in the first embodiment refer to the same parts and their description is omitted here in order to simplify the explanation.

Figure 9A:
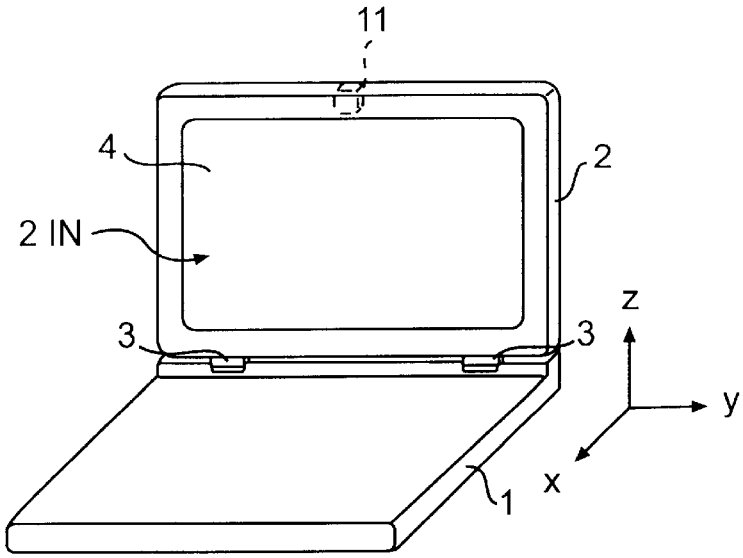
FIGS. 9*a*, 9*b*, and 9*c* are a perspective view, a front plan view, and a side plane view, respectively, illustrating a notebook personal computer including a flat antenna and in an open state in accordance with a second embodiment of the present invention.
Figure 9B:
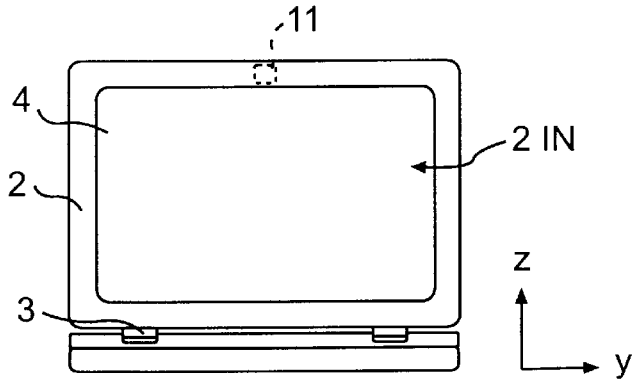
Figure 9C:
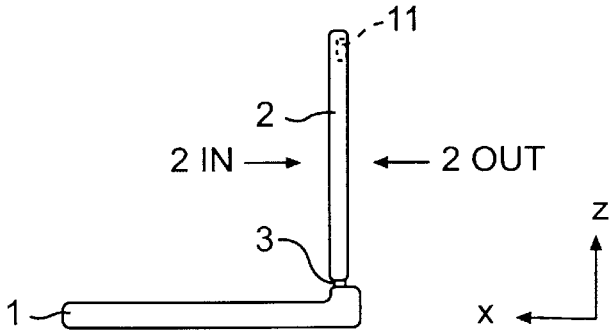

FIGS. 9*a,* 9*b,* and 9*c* are a perspective view, a front plan view, and a side plane view, respectively, illustrating a notebook personal computer including a flat antenna 11 and in an open state in accordance with a second embodiment of the present invention. Here, the flat antenna 11 is disposed almost at the center of the distal end of the display unit 2 so that it has a directivity characteristic in the back direction of the liquid crystal display panel 4. The display unit 2 has two surfaces which are an inner surface 2in and an outer surface 2out. When the main unit 1 and the display unit 2 is closed, the inner surface 2in is invisible. On the other hand, the outer surface 2out is visible even if the main unit 1 and the display unit 2 are closed. The flat antenna 11 is arranged on the outer surface 2out.

Figure 10A:
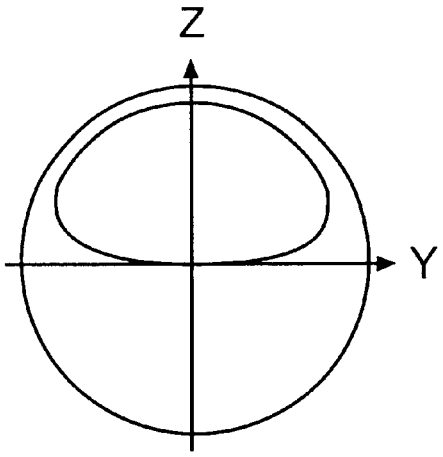
FIGS. 10*a* and 10*b* show radiation characteristics of the flat antenna of FIGS. 9*a*, 9*b*, and 9*c* in accordance with the second embodiment of the present invention.
Figure 10B:
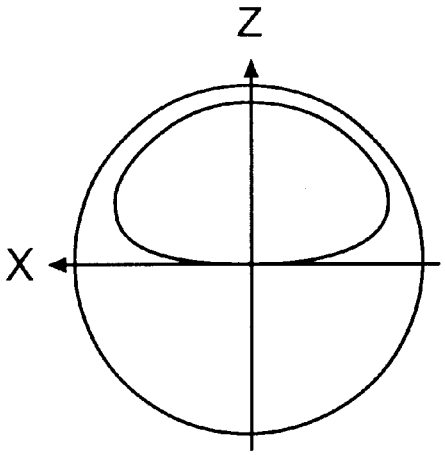

FIGS. 10*a* and 10*b* show radiation characteristics of the flat antenna 11 of FIGS. 9*a,* 9*b*, and 9*c* in accordance with the second embodiment of the present invention.

As shown in the radiation characteristics in the Z-Y plane shown in FIG. 10*a* and in the Z-X plane shown in FIG. 10*b,* favorable radiation characteristics may be obtained also when the flat antenna 11 is disposed approximately at the center of the distal end of the display unit 2 so as to have the directivity characteristic in the back direction of the liquid crystal display panel 4.

Next, a third embodiment of the present invention is described with reference to FIGS. 11*a* through 11*b*.

Figure 11A:
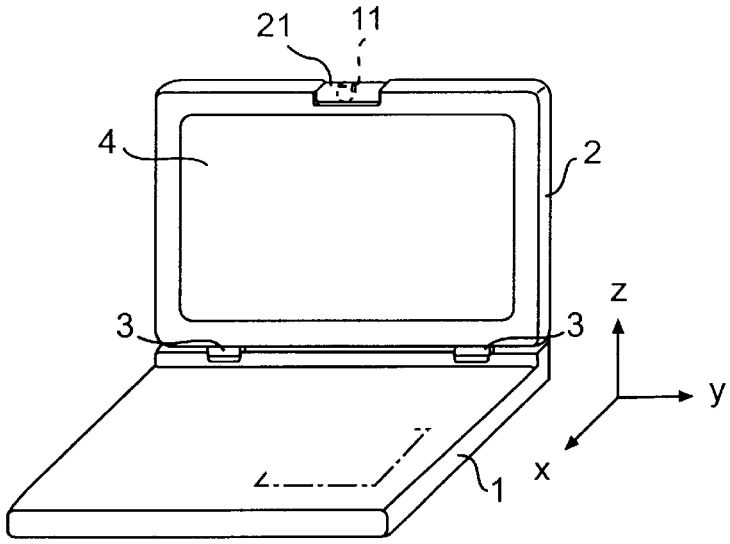
FIGS. 11*a*, 11*b*, and 11*c* are a perspective view, a front plan view, and a side plane view, respectively, illustrating a notebook personal computer including a flat antenna and in an open state in accordance with a third embodiment of the present invention.
Figure 11B:
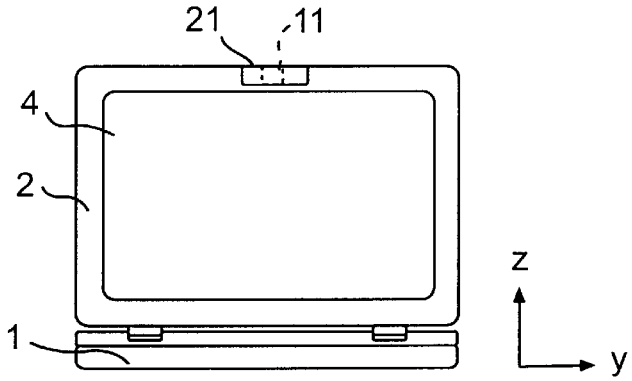
Figure 11C:
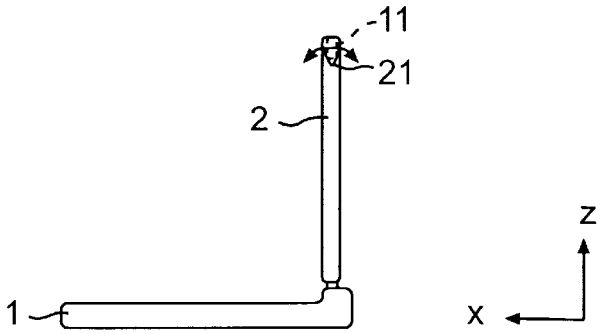

FIGS. 11*a,* 11*b,* and 11*c* are a perspective view, a front plan view, and a side plane view, respectively, illustrating a notebook personal computer including a flat antenna 11 and in an open state in accordance with a third embodiment of the present invention.

In the third embodiment of the present invention, the direction of the flat antenna 11 may be varied in direction. For example, the flat antenna 11 is arranged so that the direction of the directivity characteristic of the flat antenna 11 may be varied in the whole azimuth range or within a predetermined range in a specific azimuth range. Specifically, the direction of the directivity characteristic of the flat antenna 11 may be varied with a predetermined angle in the specified azimuth range, i.e., in a certain direction. For example, the angle may be turnable by 90 degrees each in the front and back directions when seen from the front of the liquid crystal display panel 4.

The display unit 2 includes an antenna supporting member 21 turnably supported on a fulcrum of both side walls of a concave cutaway portion formed approximately at the center of the distal end of the display unit 2. The flat antenna 11 is supported by the antenna supporting member 21 while being stored and fixed therein. Here, the antenna supporting member 21 may be turned by ±90 degrees in the front and back directions when seen from the front side of the liquid crystal display panel 4. Accordingly, the directivity characteristic of the flat antenna 11 may be varied from −90 degrees to +90 degrees based on the direction of the display of the liquid crystal display panel 4 disposed in the display unit 2. The user can always set the angle of the flat antenna 11 so that the flat antenna 11 can transmit/receive favorably by providing such antenna turning mechanism.

Next, a fourth embodiment of the present invention is described with reference to FIG. 12.

Figure 12:
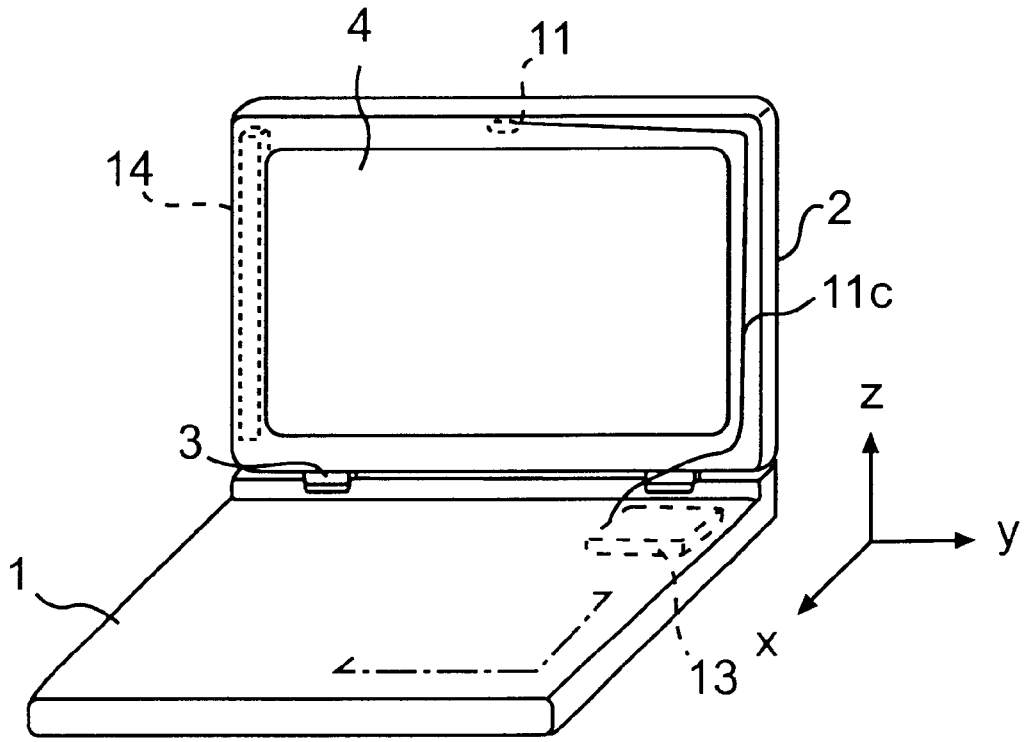
FIG. 12 is a perspective view illustrating a notebook PC including a flat antenna and a coaxial cable according to a fourth embodiment of the present invention.

FIG. 12 is a perspective view illustrating a notebook PC in accordance with a fourth embodiment of the present invention. A main unit 1 includes a radio frequency (RF) module 13. The display unit 2 includes a cable 11*c* and a liquid crystal driver circuit 14. The cable 11*c* may be, for example a coaxial cable, and couples the flat antenna 11 to the RF module 13. The liquid crystal driver circuit 14 is mounted on one side of the liquid crystal display panel 4, for example, the left side as shown in FIG. 12. According to the fourth embodiment of the present invention, a position for wiring a cable 11*c* of the flat antenna 11 is specified to avoid the influence of noise as much as possible. The cable wiring of the fourth embodiment of the present invention may be applied to each embodiment described above and below.

The coaxial cable 11*c* connected to the flat antenna 11 propagates a transmitting/receiving signal of the ISM band between the flat antenna 11 and the RF module 13. The RF module 13 connected with the flat antenna 11 via the coaxial cable 11*c* is placed on a main board within the PC main unit 1. The liquid crystal driver circuit 14 drives the display of the liquid crystal display panel 4 and may become a source of noise that effects the transmitting/receiving signal of the flat antenna 11.

In connecting the coaxial cable 11C coupled to the flat antenna 11 to the main unit 1 via the display unit 2, the cable 11C is routed within the display unit 2 to avoid the liquid crystal driver circuit 14 by separating the coaxial cable 11C from the liquid crystal driver circuit 14 in each embodiment described above and below. Because the liquid crystal driver circuit 14 preferably is mounted at one side within the display unit 2, the coaxial cable 11C is wired via the other side within the display unit 2 preferably with a maximum separation from the liquid crystal driver circuit 14. Accordingly, the RF module 13 is much less effected by noise radiated from the liquid crystal driver circuit 14, and the influence of noise radiated from the liquid crystal driver circuit 14 via the flat antenna 11 may be avoided by wiring the coaxial cable 11C as described above.

Next, a fifth embodiment of the present invention is described with reference to FIGS. 13*a* and 13*b*.

Figure 13A:
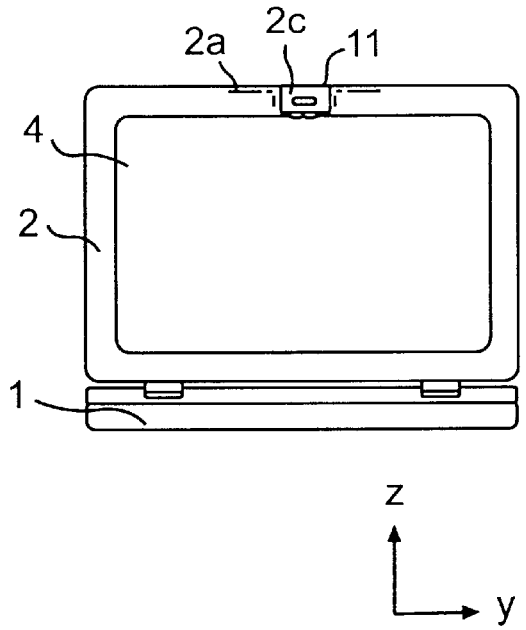
FIGS. 13*a* and 13*b* are a front plan view and a side plane view, respectively, illustrating a notebook personal computer including a flat antenna and in an open state in accordance with a fifth embodiment of the present invention.
Figure 13B:
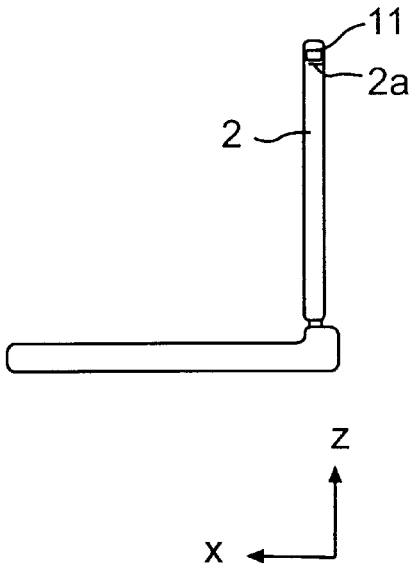
Figure 13C:
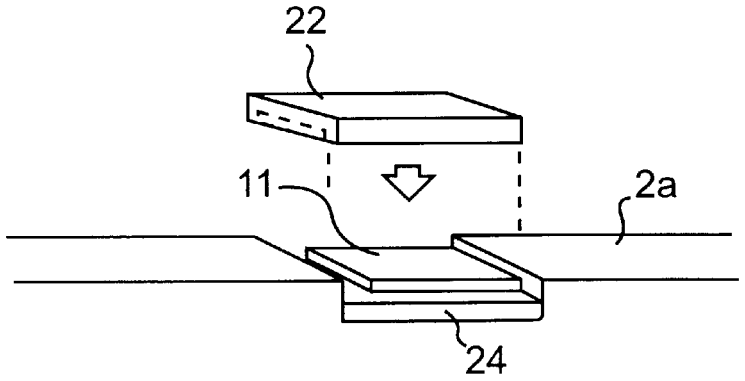
FIG. 13*c* is an expanded exploded view of the flat antenna in accordance with the fifth embodiment of the present invention.

FIGS. 13*a* and 13*b* are a front plan view and a side plane view, respectively, illustrating a notebook personal computer including a flat antenna 11 and in an open state in accordance with a fifth embodiment of the present invention. FIG. 13*c* is an expanded exploded view of the flat antenna 11 in accordance with the fifth embodiment of the present invention. The display unit 2 includes a conductive cover 2A, a mold cover 22, and a nonconductive insulating element 24. In the fifth embodiment of the present invention, the display unit 2 is formed of an electrically conductive cover, such as magnesium alloy, except on the distal end. Here, the display unit 2 includes an opening 2C having a bottom surface on which the insulating element 24 is mounted. The flat antenna 11 is mounted on the top surface (in the open position) of the insulating element 24. The mold cover 22 is disposed over the antenna 11 so that the top surface of the mold cover 22 is flush with the top surface of the display unit 2. Similarly, the outside surfaces of the mold cover 22 are flush with the outside surfaces of the display unit 2. The periphery of the mounting area of the flat antenna 11 is shielded by the conductive cover 2A except of the upper surface thereof.

The opening 2C for mounting the flat antenna 11 is formed approximately at the center of the distal end of the display unit 2 and each plane (five planes) except of the above-mentioned upper opening of the opening 2C is shielded by the conductive cover 2A The flat antenna 11 is fixed within the opening 2C via the insulating element 24 and the opening at the upper surface thereof is also covered by the insulating mold cover 22.

By mounting and constructing the antenna as described above, radiation noise from the liquid crystal display panel 4 may be shut off and the transmitting/receiving environment may be improved. Further, it has no projecting antenna, it may be handled readily and allows to have communication simply without requiring the user to manipulate the antenna by extending/shortening it.

Next, a sixth embodiment of the present invention is described with reference to FIG. 14.

Figure 14A:
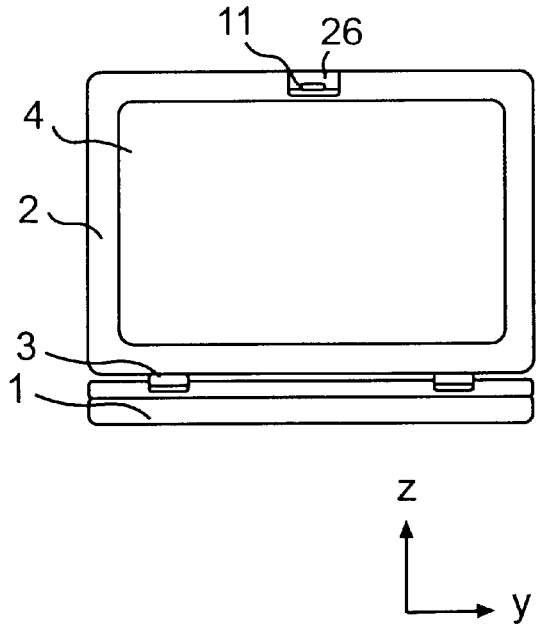
FIGS. 14*a* and 14*b* are a front plan view and a side plane view, respectively, illustrating a notebook personal computer including a flat antenna and in an open state in accordance with a sixth embodiment of the present invention.
Figure 14B:
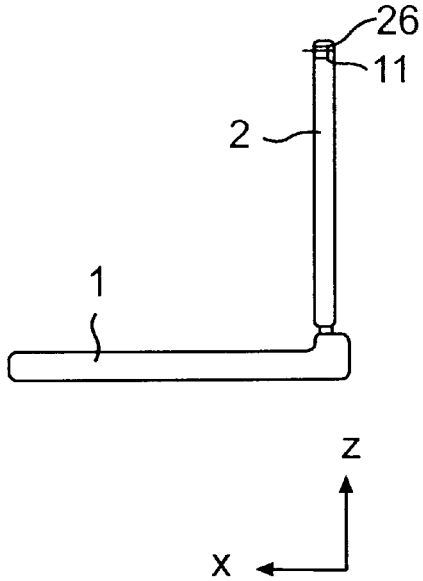
Figure 14C:
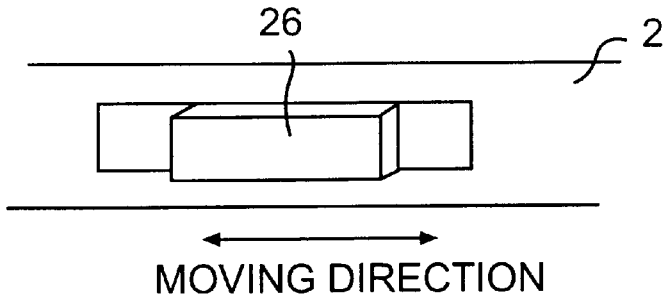
FIG. 14*c* is an exploded view of the lock mechanism of the notebook personal computer in accordance with the sixth embodiment of the present invention.

FIGS. 14*a* and 14*b* are a front plan view and a side plane view, respectively, illustrating a notebook personal computer including a flat antenna 11 and in an open state in accordance with a sixth embodiment of the present invention. FIG. 14*c* is an exploded view of the lock mechanism of the notebook personal computer in accordance with the sixth embodiment of the present invention. In the sixth embodiment of the present invention, the space for mounting the flat antenna 11 in the display unit 2 is minimized. The flat antenna 11 is embedded within an opening lock button 26 of the display unit 2, and the lock button is movable in a moving direction and normally in the left side. When the lock button 26 is moved from the left side to the right side in the moving direction, the lock condition is released. The space for mounting the antenna in the liquid crystal display unit 2 may be eliminated and the whole apparatus may be miniaturized further by mounting the antenna as described above.

The present invention may be embodied in other specific forms without departing form the spirit or essential characteristics thereof The present embodiments are therefore to be considered in all respects as illustrative and not respective, the scope of the present invention being indicated by the appended claims rather than by the foregoing description and all changes which come within the meaning and range of equivalency of the claims are therefore intended to be embraced therein.

What is claimed is:

1. An information processor, comprising:

a main unit;

a hinge mechanism mounted at a back end of said main unit;

a display unit connected to the hinge mechanism at a lower end of the display unit and movable between a first position and a second position;

an antenna disposed on an upper surface portion of said display unit, said upper surface being opposite the lower end;

a display driver circuit disposed adjacent a first side of said display unit; and a coaxial cable wired between said antenna and said main unit via a second side of said display unit opposite the first side.

2. The information processor according to claim 1, wherein the display unit has an inner surface and an outer surface, and wherein the information processor has a vector normal to the inner surface and pointing outward from the inner surface and a plane orthogonal to the inner surface and parallel to the lower end, wherein said antenna is disposed so that a majority of radiated energy in the plane exists in a first 90 degree region between +45 degrees from the vector to −45 degrees of the vector and a second 90 degree region between +135 degrees from the vector to −135 degrees from the vector.

3. The information processor according to claim 1, wherein said antenna is disposed so that its directivity pattern extends more above than below said display unit when seen from the front of said display unit.

4. The information processor according to claim 1, wherein said antenna is disposed so that its directivity pattern extends more above than below said display unit when seen from the side of said display unit.

5. The information processor according to claim 1, wherein said antenna is mounted to be turnable between first and second orientations relative to said display unit.

6. An information processor, comprising:

a display case including a main unit, a hinge mechanism at a back end of said main unit, and a display unit connected to the hinge mechanism at a lower end of the display unit and turnable between a first position and a second position;

an opening lock button disposed approximately at the center of a free end of said display unit, said lock button for locking together the main unit and the display unit; and an antenna mounted in said opening lock button.

7. The information processor according to claim 6, wherein the display unit has an inner surface and an outer surface, and wherein the information processor has a vector normal to the inner surface and pointing outward from the inner surface and a plane orthogonal to the inner surface and parallel to the lower end, wherein said antenna is disposed so that a majority of radiated energy in the plane exists in a first 90 degree region between +45 degrees from the vector to −45 degrees of the vector and a second 90 degree region between +135 degrees from the vector to −135 degrees from the vector.

8. The information processor according to claim 6, wherein said antenna is disposed so that its directivity pattern extends more above than below said display unit when seen from the front of said display unit.

9. The information processor according to claim 6, wherein said antenna is disposed so that its directivity pattern extends more above than below said display unit when seen from the side of said display unit.

10. The information processor according to claim 6, wherein said antenna is mounted to be turnable between first and second orientations relative to said display unit.

11. An information processor, comprising:

a first unit;

a processing unit mounted on the first unit;

a second unit having an inner surface, an outer surface, a first end, a second end opposite the first end, and two opposing sides;

a display unit mounted on the inner surface of the second unit;

a hinge mechanism connected between the first unit and the first end of of the second unit; and an antenna mounted on a predetermined position of the outer surface, the predetermined position being closer to the second end than the first end and approximately midway between the first and second sides.

12. The information processor according to claim 11, wherein the information processor has a vector normal to the inner surface and pointing outward from the inner surface and a plane orthogonal to the inner surface and parallel to the first end, wherein said antenna is disposed so that a majority of radiated energy in the plane exists in a first 90 degree region between +45 degrees from the vector to −45 degrees of the vector and a second 90 degree region between +135 degrees from the vector to −135 degrees from the vector.

13. The information processor according to claim 11, wherein said antenna is disposed so that its directivity pattern extends more above than below the display unit when seen from the front of said display unit.

14. The information processor according to claim 11, wherein said antenna is disposed so that its directivity pattern extends more above than below the display unit when seen from the side of said display unit.

15. The information processor according to claim 11, wherein said antenna is mounted to be turnable between first and second orientations relative to said display unit.

16. The information processor of claim 11, wherein the predetermined region is on an upper surface portion of said display unit, wherein the upper surface portion is opposite the lower end of the display unit.

17. The information processor according to claim 16, wherein the information processor has a vector normal to the inner surface and pointing outward from the inner surface and a plane orthogonal to the inner surface and parallel to the first end, wherein said antenna is disposed so that a majority of radiated energy in the plane exists in a first 90 degree region between +45 degrees from the vector to −45 degrees of the vector and a second 90 degree region between +135 degrees from the vector to −135 degrees from the vector.

18. The information processor according to claim 16, wherein said antenna is disposed so that its directivity pattern extends more above than below the display unit when seen from the front of said display unit.

19. The information processor according to claim 16, wherein said antenna is disposed so that its directivity pattern extends more above than below the display unit when seen from the side of said display unit.

20. The information processor according to claim 16, wherein said antenna is mounted to be turnable between first and second orientations relative to said display unit display case.

21. The information processor of claim 11 wherein the predetermined region is approximately at the center of an upper surface portion of said display unit, wherein the upper surface portion is opposite the lower end of the display unit.

22. The information processor according to claim 21, wherein the information processor has a vector normal to the inner surface and pointing outward from the inner surface and a plane orthogonal to the inner surface and parallel to the first end, wherein said antenna is disposed so that a majority of radiated energy in the plane exists in a first 90 degree region between +45 degrees from the vector to −45 degrees of the vector and a second 90 degree region between +135 degrees from the vector to −135 degrees from the vector.

23. The information processor according to claim 21, wherein said antenna is disposed so that its directivity pattern extends more above than below the display unit when seen from the front of said display unit.

24. The information processor according to claim 21, wherein said antenna is disposed so that its directivity pattern extends more above than below the display unit when seen from the side of said display unit.

25. The information processor according to claim 21, wherein said antenna is mounted to be turnable between first and second orientations relative to said display unit.

26. An information processor, comprising:

a main unit;

a display unit;

means for moving the display unit between a first position and a second position;

an antenna disposed on an upper surface portion of said display unit, said upper surface being opposite a lower end of said display unit;

means for driving the display unit disposed adjacent a first side of said display unit; and means for electrically connecting the antenna and said main unit via a second side of said display unit opposite the first side.

27. An information processor, comprising:

a main unit;

a display unit;

means for moving the display unit between a first position and a second position relative to the main unit; and means for locking the display unit and the main unit together in the first position, the locking means being disposed approximately at the center of a free end of said display unit; and including means for electromagnetically communicating with an external apparatus mounted in said locking means.

* * * * *